US012150480B1

(12) United States Patent
He

(10) Patent No.: US 12,150,480 B1
(45) Date of Patent: Nov. 26, 2024

(54) ELECTRONIC CIGARETTE HAVING LIQUID PASSING CHAMBER

(71) Applicant: PAX Innovations (Shenzhen) Limited, Shenzhen (CN)

(72) Inventor: Wei He, Shenzhen (CN)

( * ) Notice: Subject to any disclaimer, the term of this patent is extended or adjusted under 35 U.S.C. 154(b) by 0 days.

(21) Appl. No.: 18/625,750

(22) Filed: Apr. 3, 2024

(30) Foreign Application Priority Data

Mar. 8, 2024 (CN) ..... 202420471044.1
Mar. 18, 2024 (CN) ..... 202420532506.6

(51) Int. Cl.
*A24F 40/42* (2020.01)
*A24F 40/10* (2020.01)
*A24F 40/46* (2020.01)

(52) U.S. Cl.
CPC ..... *A24F 40/42* (2020.01); *A24F 40/10* (2020.01); *A24F 40/46* (2020.01)

(58) Field of Classification Search
CPC ..... A24F 40/42; A24F 40/10; A24F 40/46
See application file for complete search history.

(56) References Cited

U.S. PATENT DOCUMENTS 10,631,576 B1 * 4/2020 Chen ..... A24F 40/40
2021/0219607 A1 * 7/2021 Ou ..... A24F 40/42
2022/0151301 A1 * 5/2022 Liu ..... A24F 40/44

* cited by examiner

*Primary Examiner* — Abdullah A Riyami
*Assistant Examiner* — Thang H Nguyen

(57) ABSTRACT

An electronic cigarette includes a main body of electronic cigarette, and liquid storage chambers for storing tobacco liquid. The main body of electronic cigarette is equipped with installation cavities. The liquid storage chambers are at least partially placed in the installation cavities. The liquid storage chambers are equipped with a liquid outlet hole for discharging tobacco liquid. The main body of electronic cigarette is equipped with a liquid passing chamber and at least one atomizing core. A liquid passing cavity is provided inside the liquid passing chamber, and the liquid passing cavity is in communication with an interior of the atomizing core. The liquid passing cavity is positioned on an outer side of the atomizing core. After the liquid storage chambers are assembled into the installation cavities, the liquid outlet hole is in communication with the liquid passing cavity.

19 Claims, 14 Drawing Sheets

ELECTRONIC CIGARETTE HAVING LIQUID PASSING CHAMBER

CROSS-REFERENCE TO RELATED APPLICATIONS

The application claims priorities of Chinese patent applications CN2024205325066 and CN2024204710441, filed on Mar. 18, 2024 and Mar. 8, 2024, which are incorporated herein by references in its entireties.

TECHNICAL FIELD

The present invention relates to a technical field of smoking sets, in particular to an electronic cigarette.

BACKGROUND ART

As is well known, when a disposable electronic cigarette leaves the factory, a capacity of tobacco liquid of the disposable electronic cigarette is fixed, and a capacity of a battery is also fixed. After the tobacco liquid or an electrical quantity of the battery is used up, a service life of the disposable electronic cigarette ends. Therefore, there is an urgent need on the market for an electronic cigarette that can be assembled with a liquid tank to increase the capacity of the tobacco liquid. However, during this process, due to a small volume of an atomizing core used for atomizing the tobacco liquid, it is difficult to let the liquid tank directly communicate with an interior of the atomizing core.

SUMMARY

A main purpose of the present invention is to provide an electronic cigarette for solving a problem of difficult liquid tank configuration due to a small volume of the atomizing core in the electronic cigarette.

In order to solve the above-mentioned technical problem, a technical solution is provided by the present invention.

An electronic cigarette includes a main body of electronic cigarette, and liquid storage chambers for storing tobacco liquid.

The main body of electronic cigarette is provided with installation cavities, and the liquid storage chambers are at least partially placed inside the installation cavities. The liquid storage chambers are provided with a liquid outlet hole for discharging tobacco liquid.

The main body of electronic cigarette is equipped with a liquid passing chamber and at least one atomizing core. A liquid passing cavity is arranged inside the liquid passing chamber, and the liquid passing cavity is in communication with an interior of the atomizing core. The liquid passing cavity is positioned on an outer side of the atomizing core.

After the liquid storage chambers are assembled to the installation cavities, the liquid outlet hole is in communication with the liquid passing cavity.

Furthermore, a joint structure is provided between the liquid passing chamber and the liquid storage chambers.

The joint structure includes a first insertion hole and an insertion end adapted for use with the first insertion hole. The insertion end is provided with a first channel, and the first channel runs through the insertion end. After the liquid storage chambers are assembled into the installation cavities, the insertion end is at least partially placed inside the first insertion hole. Two ends of the first channel are respectively in communication with the liquid outlet hole and the liquid passing cavity.

Furthermore, the insertion end is arranged on the liquid storage chambers. The first insertion hole is defined in the liquid passing chamber, and first sealing rings are arranged between the insertion end and the liquid passing chamber.

Furthermore, a side projection of the first sealing rings is in a shape of "I" in upper case. An inner side wall of the first sealing rings is equipped with a first sealing protrusion for abutting against an outer side wall of the insertion end.

Furthermore, the atomizing core includes: an annular housing body, liquid absorbing cotton provided within the annular housing body, and a heating wire provided at a bottom of the liquid absorbing cotton. The annular housing body is provided with a liquid passing hole, and the liquid passing hole is in communication with the liquid passing cavity.

Furthermore, the annular housing body is at least partially placed inside the liquid passing cavity, and the liquid passing hole is defined at a position corresponding to the liquid passing cavity. A second sealing ring is arranged between the annular housing body and the liquid passing chamber.

Furthermore, the liquid absorbing cotton is in an annular shape, and the heating wire is positioned on a central axis of the liquid absorbing cotton.

Furthermore, the liquid passing chamber includes a first top housing and a first outer housing. The first outer housing is connected to the first top housing to form the liquid passing cavity. A third sealing ring is provided between the first top housing and the first outer housing. The second sealing ring is provided between the annular housing body and the first top housing.

Furthermore, the first top housing extends downwards to form a first enclosure wall. A first slot is provided on the first enclosure wall. The second sealing ring is at least partially placed in the first slot, and the first enclosure wall is placed in the liquid passing cavity.

Furthermore, a second insertion hole is provided on the first top housing. A side projection of the second sealing ring is in a shape of "I" in upper case, and the second sealing ring is arranged around a side wall of the second insertion hole. An inner side wall of the second sealing ring is provided with a second sealing protrusion for abutting against the annular housing body.

Furthermore, a receiving slot is provided at a bottom of the liquid passing cavity, and a bottom of the annular housing body is placed inside the receiving slot. A bottom of the receiving slot is provided with a through hole, and the through hole is in communication with the annular housing body. A fourth sealing ring is arranged between the bottom of the annular housing body and a bottom surface of the receiving slot.

Furthermore, the main body of electronic cigarette is further equipped with a circuit board, a battery, and a pneumatic switch. The battery, the heating wire, and the pneumatic switch are all electrically connected to the circuit board. The main body of electronic cigarette is provided with an air inlet hole at a position corresponding to the pneumatic switch.

A top of the main body of electronic cigarette is equipped with a mouthpiece. The mouthpiece is provided with an aerosol outlet hole, and the aerosol outlet hole is in communication with an interior of the annular housing body. Fifth sealing rings are arranged between the mouthpiece and the annular housing body.

Furthermore, the main body of electronic cigarette is further equipped with an adapter board, and the adapter board is electrically connected to the circuit board. The through hole further penetrates through the adapter board.

The adapter board is positioned below the receiving slot. A pin of the heating wire is welded to the adapter board.

Furthermore, a total number of the atomizing core and a total number of the liquid passing chamber are both one. A total number of the liquid storage chambers and a total number of the installation cavities are both two.

Each of the installation cavities is used for assembling one of the liquid storage chambers. The two installation cavities are both positioned below the liquid passing chamber. The circuit board, the battery, the pneumatic switch, and the adapter board are all positioned between the two installation cavities. The circuit board is positioned next to the battery. The pneumatic switch is positioned below the circuit board. The adapter board is positioned above the circuit board and is arranged at a bottom of the receiving slot. The air inlet hole is positioned at a bottom of the main body of electronic cigarette.

The receiving slot is formed by a downward depression of the liquid passing cavity. The through hole is positioned on the first outer housing.

Furthermore, the main body of electronic cigarette includes a second top housing, a second outer housing, and a first bottom housing. An upper end and a lower end of the second outer housing are respectively connected to the second top housing and the first bottom housing.

An outer side wall of the first outer housing extends outward to form a connecting enclosure wall. The connecting enclosure wall is connected to the second outer housing. The mouthpiece is positioned on the second top housing. The installation cavities are surrounded and formed by the second outer housing, the first bottom housing, and the first outer housing.

The fourth sealing ring extends downwards to form an installation seat. The installation seat passes through the through hole and then is placed at a bottom of the liquid passing cavity. A bottom of the installation seat is equipped with an installation slot. The adapter board is arranged inside the installation slot. The installation slot is provided with an avoidance hole for avoiding a pin of the heating wire.

Furthermore, there are two atomizing cores, two liquid passing cavities, two receiving slots, two air inlet holes, two adapter boards, and two pneumatic switches. A total number of the liquid storage chambers and a total number of the installation cavities are both two. Each of the installation cavities is used for assembling one of the liquid storage chambers. The two liquid passing cavities are horizontally arranged side by side. One end of each of the atomizing cores passes through the liquid passing cavities and then is placed in one of the receiving slots.

The main body of electronic cigarette is equipped with first tubes at positions corresponding to the two atomizing cores, and each of the two pneumatic switches is positioned in one of the first tubes. Each of the two air inlet holes is arranged corresponding to one of the first tubes and is in communication with an interior of the first tubes. Sixth sealing rings are arranged between a bottom of the first tubes and the main body of electronic cigarette, and first wiring holes are defined on the sixth sealing rings.

The circuit board is positioned between the two first tubes, the battery is positioned next to one of the first tubes, and each of the adapter boards is arranged below one of the receiving slots.

Furthermore, a total number of the liquid passing chamber is one, and the two liquid passing cavities are formed by connecting the second top housing to the second outer housing.

Furthermore, the main body of electronic cigarette includes a third top housing and a third outer housing. The third outer housing is connected to the third top housing to form a first accommodating cavity. The third top housing is detachably connected to the third outer housing. The atomizing cores, the installation cavities, the liquid passing chambers, the first tubes, the circuit board, the battery, and the adapter boards are all positioned inside the first accommodating cavity.

A total number of the mouthpiece is one, and a bottom of the mouthpiece extends outward to form a front plate. The third top housing is provided with a second slot, and the front plate is placed inside the second slot. The front plate is rotatably arranged on the third top housing. The aerosol outlet hole is in communication with another atomizing core when the front plate rotates at a preset angle relative to the third top housing.

Furthermore, the third outer housing includes a middle housing body, an inner housing body, and a second bottom housing. The middle housing body is sleeved on an outer side of the inner housing body. The third top housing and the second bottom housing are respectively connected to an upper end and a lower end of the middle housing body. An opening is defined on a top of the middle housing body. The receiving slots are positioned on the inner housing body. The adapter boards are arranged at a bottom of the inner housing body. An interior of the middle housing body is equipped with convex columns for limiting positions of the liquid storage chambers. The liquid passing chamber is positioned inside the middle housing body, and the first tubes are positioned below the middle housing body.

Furthermore, there are two atomizing cores, two receiving slots, two air inlet holes, two adapter boards, two pneumatic switches, two liquid storage chambers, and two installation cavities. A total number of the liquid passing cavity is one.

Each of the installation cavities is used for assembling one of the liquid storage chambers. The two atomizing cores are arranged horizontally side by side. One end of each of the atomizing cores passes through the liquid passing cavity and then is placed in one of the receiving slots.

The main body of electronic cigarette is equipped with second tubes at positions corresponding to the two atomizing cores. Each of the two pneumatic switches is positioned in one of the second tubes. Each of the two air inlet holes is arranged corresponding to one of the second tubes and is in communication with an interior of the second tubes. A seventh sealing ring is provided between a bottom of the second tubes and the main body of electronic cigarette. A second wiring hole is defined on the seventh sealing ring.

The circuit board is positioned between the two second tubes. The battery is positioned next to one of the second tubes. Each of the adapter boards is arranged below one of the receiving slots.

Compared to existing technology, in the present invention, by arranging the installation cavities on the main body of electronic cigarette to facilitate the assembly of the liquid storage chambers, a capacity of the tobacco liquid of the electronic cigarette is increased, a total number of puffs for users is increased, and a service life of the electronic cigarette is improved. Moreover, by configuring the liquid passing cavity between the liquid storage chambers and the atomizing core, the tobacco liquid flowing out of the liquid outlet hole from the liquid storage chambers is added to the atomizing core through the liquid passing cavity, so as to solve the problem of difficulty in configuring the liquid tank due to the small volume of the atomizing core in the electronic cigarette, thereby facilitating the production of the electronic cigarette.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
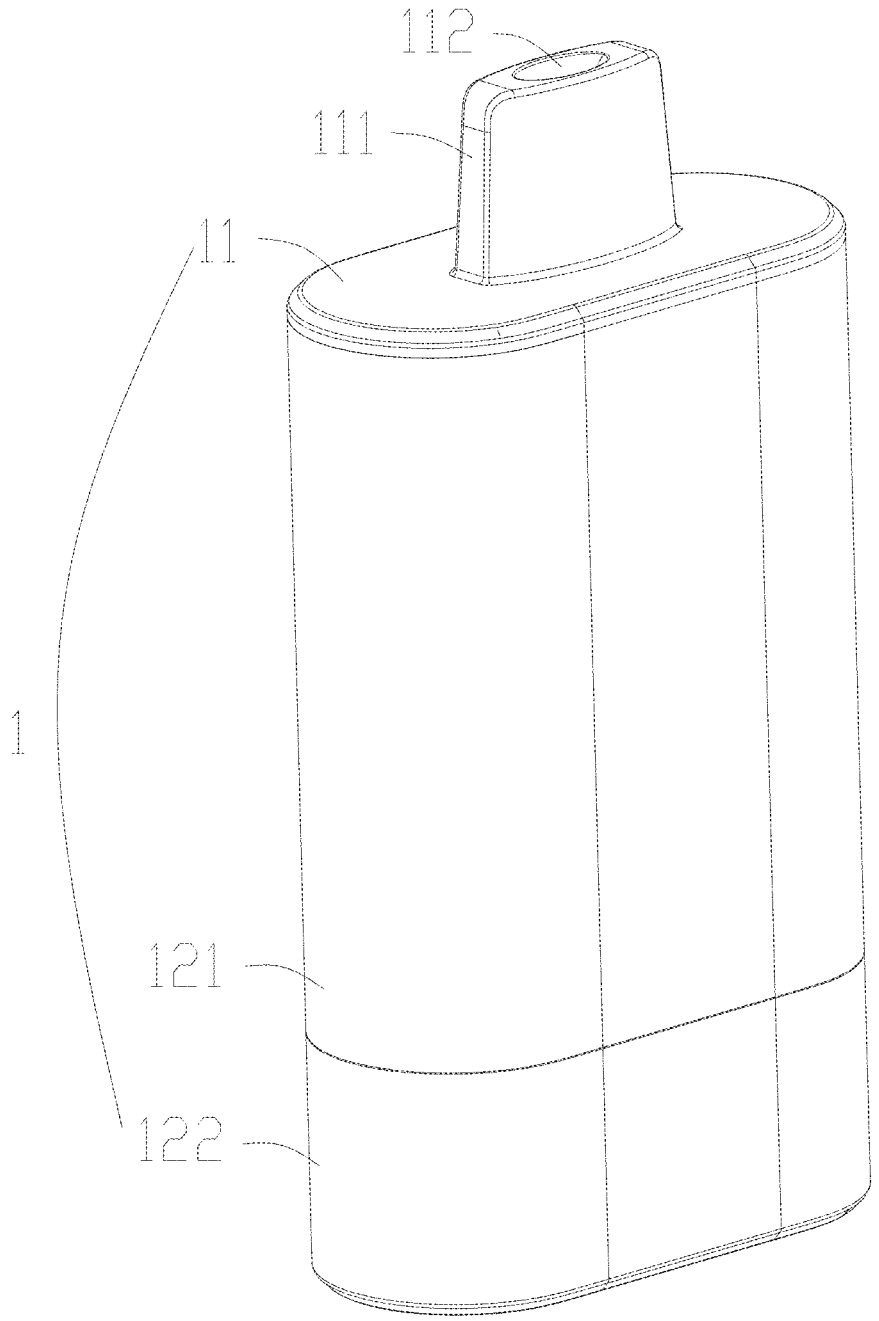
FIG. 1 is a perspective view of one embodiment according to the present invention.
Figure 2:
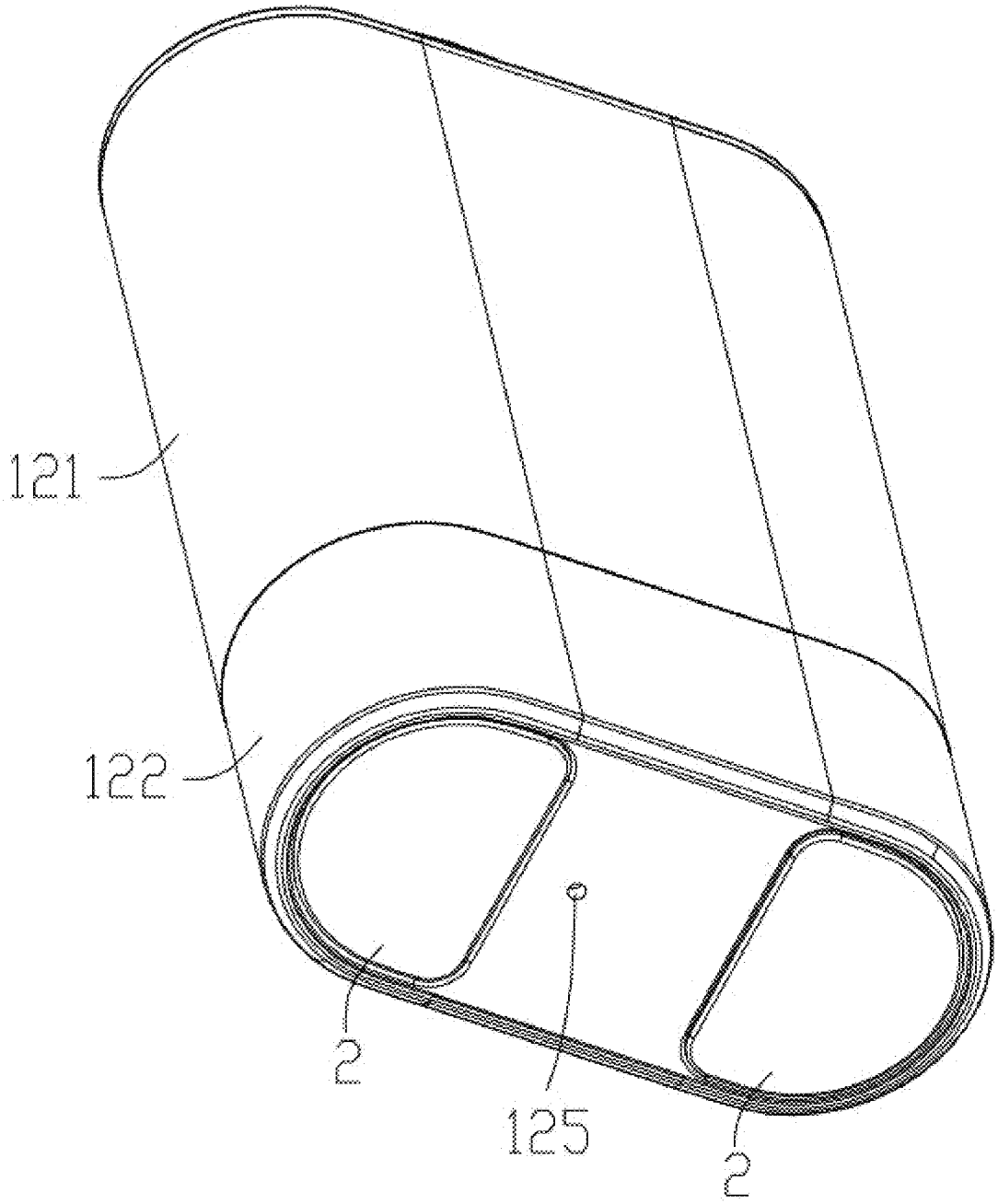
FIG. 2 is a perspective view of one embodiment from another perspective according to the present invention.
Figure 3:
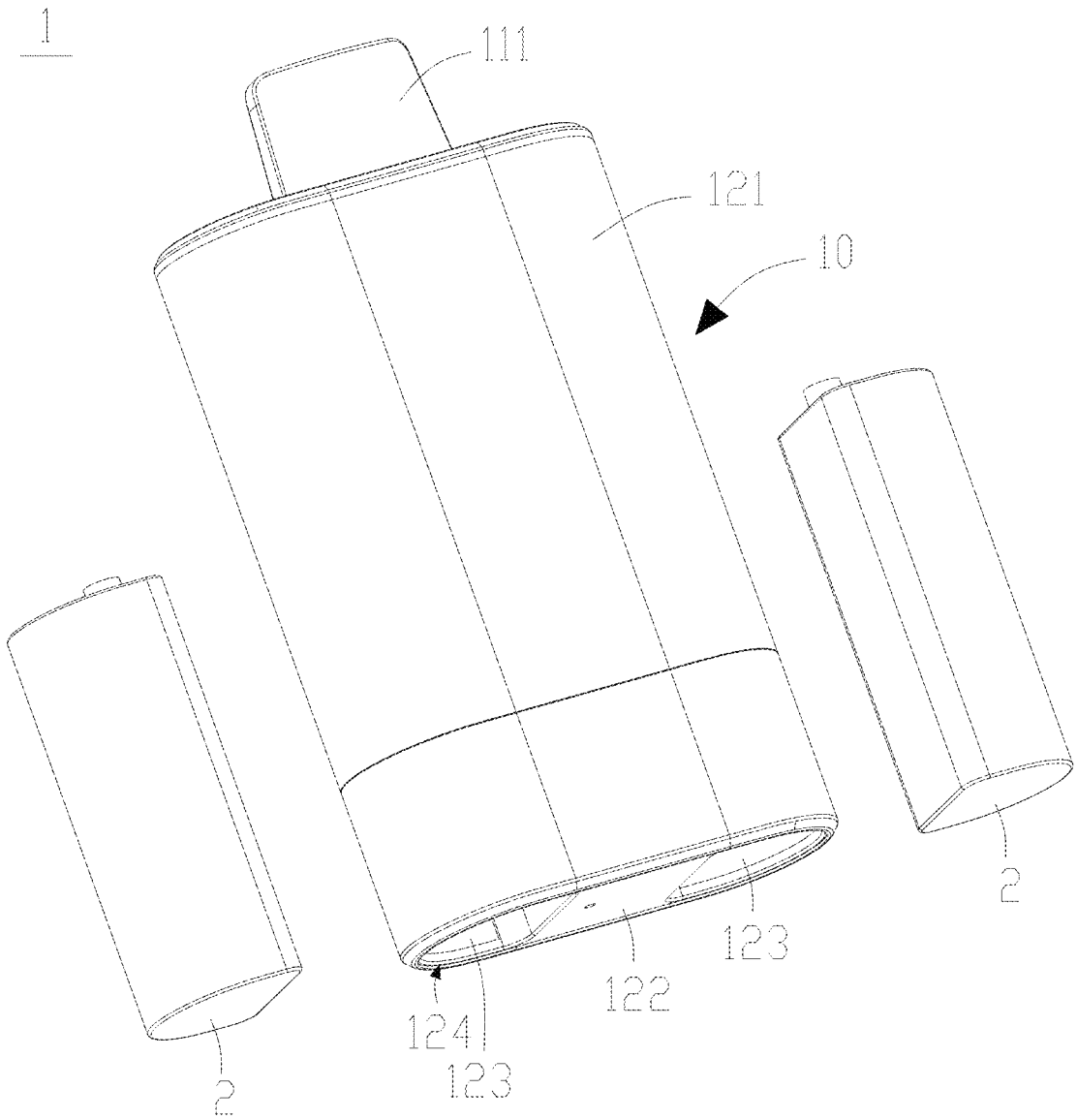
FIG. 3 is a partial exploded view of one embodiment according to the present invention.
Figure 4:
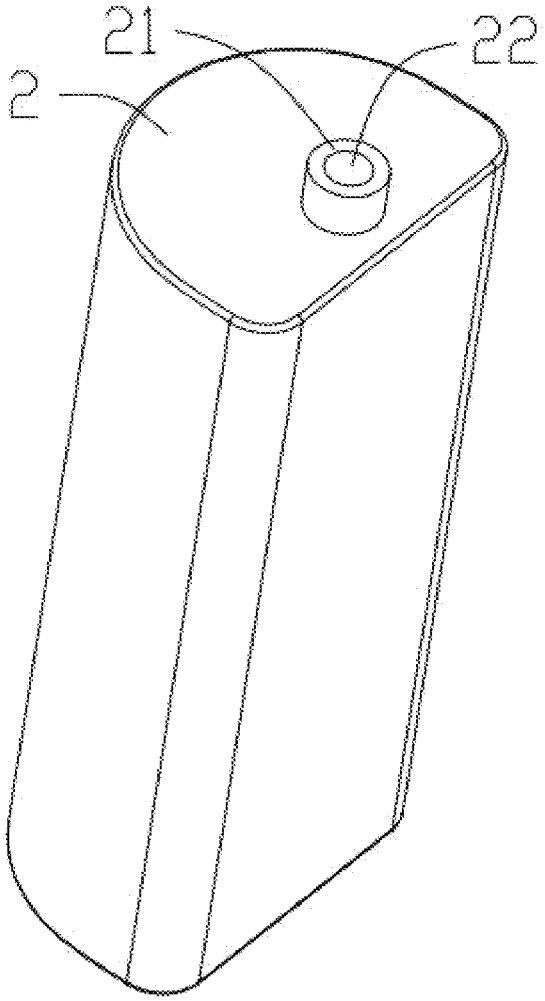
FIG. 4 is a perspective view of a liquid storage chamber in one embodiment according to the present invention.
Figure 5:
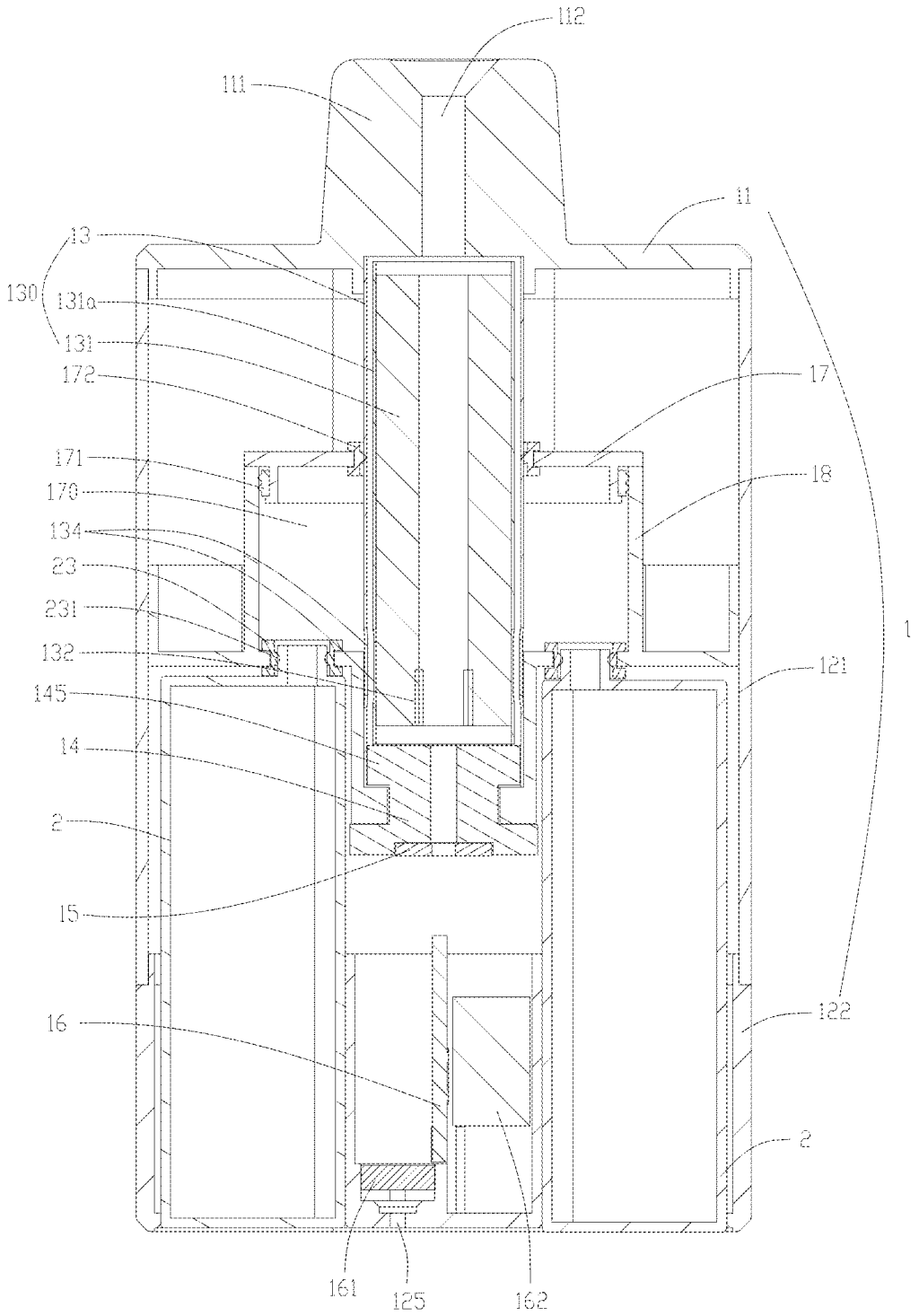
FIG. 5 is a sectional view along a center line of an aerosol outlet hole in one embodiment according to the present invention.
Figure 6:
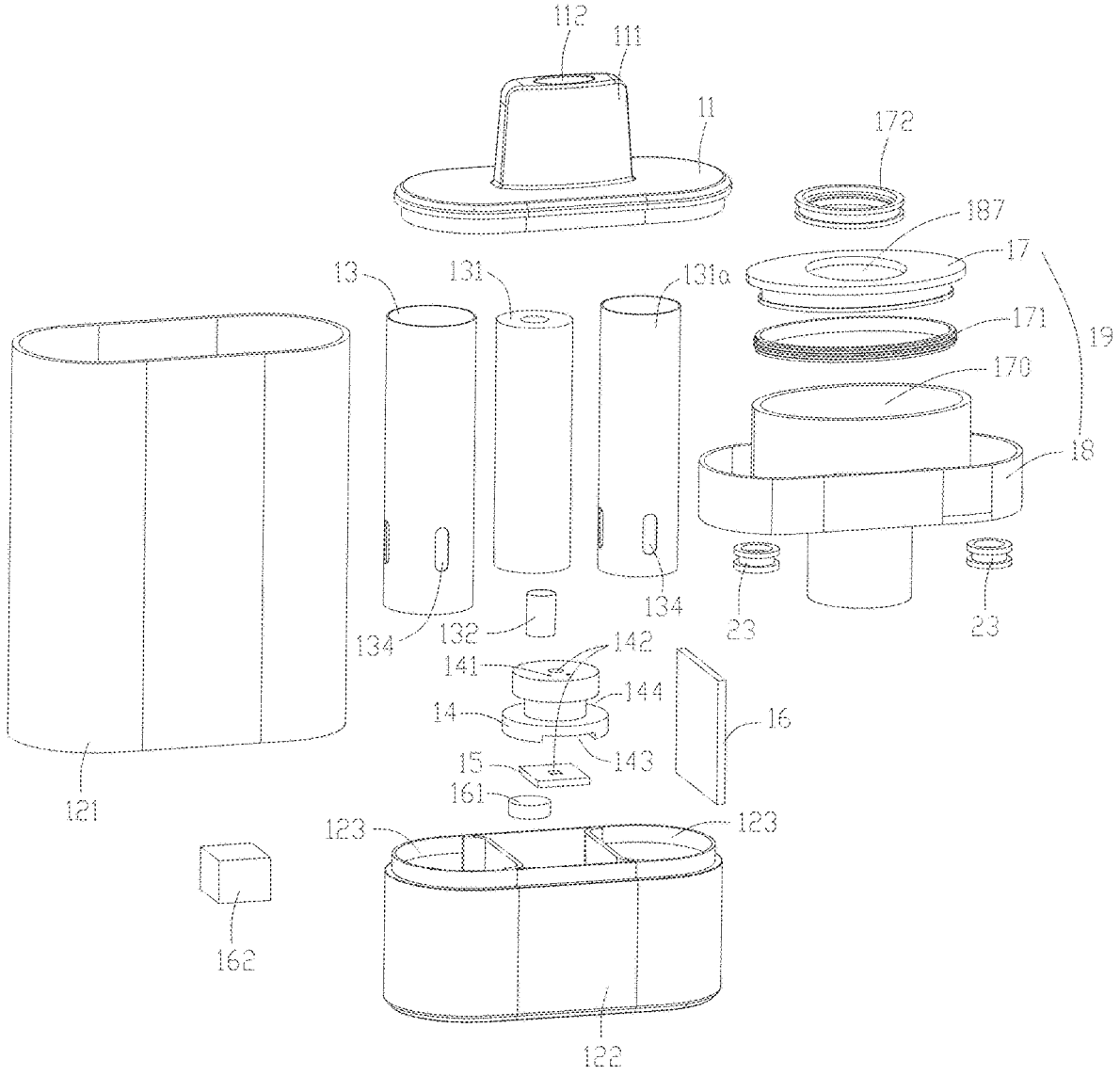
FIG. 6 is an exploded view of one embodiment according to the present invention.
Figure 7:
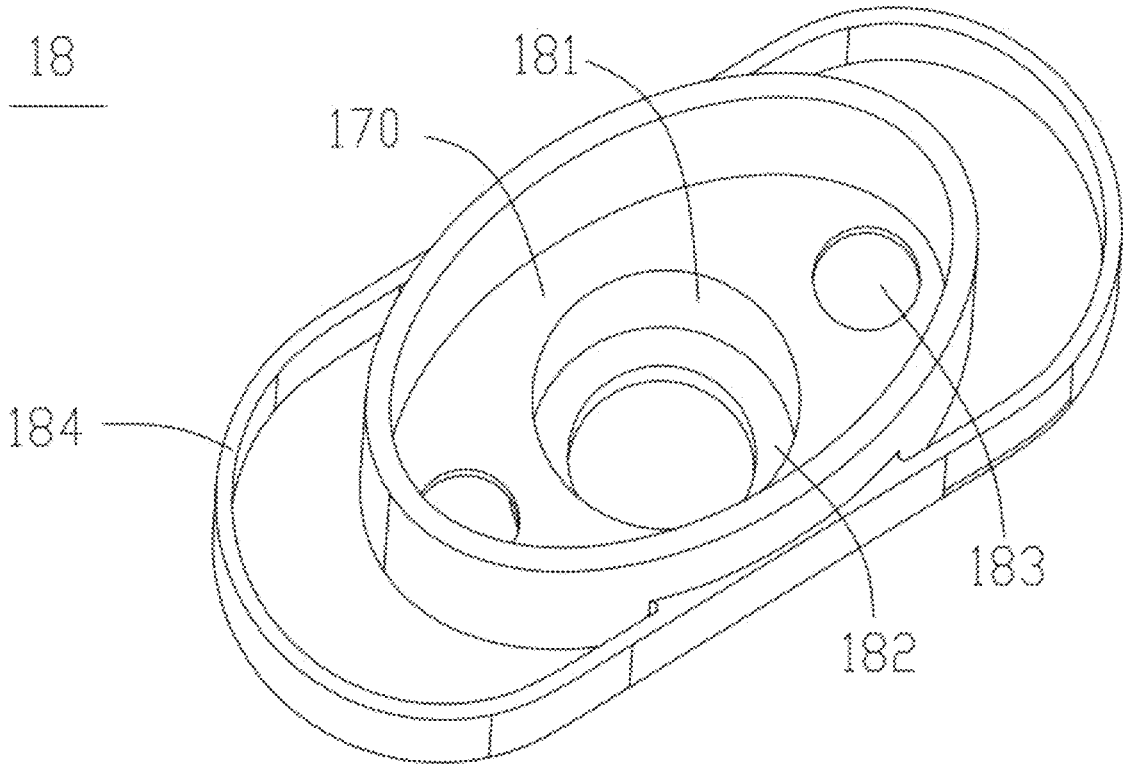
FIG. 7 is a structural diagram of a first outer housing in one embodiment according to the present invention.
Figure 8:
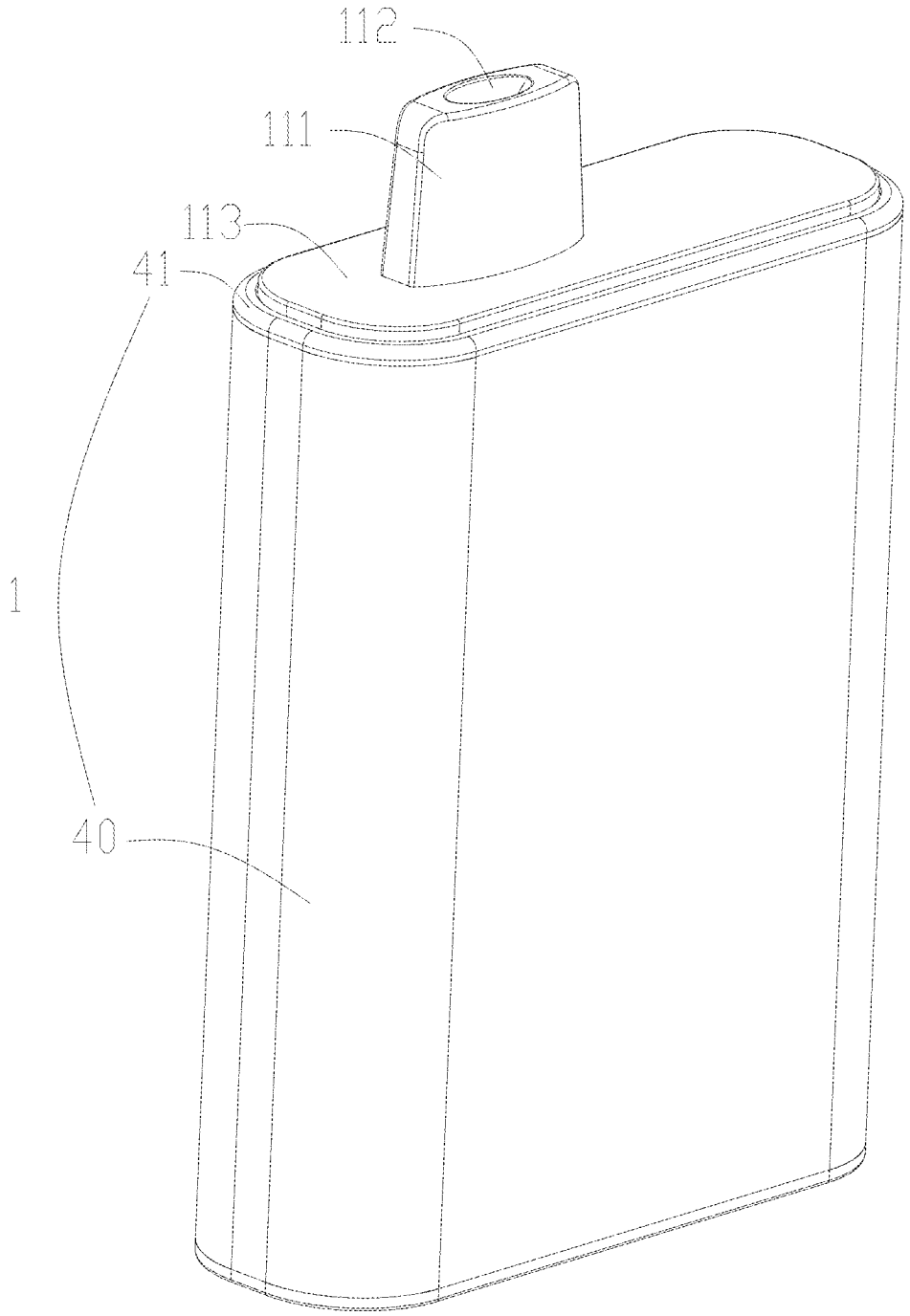
FIG. 8 is a perspective view of another embodiment according to the present invention.
Figure 9:
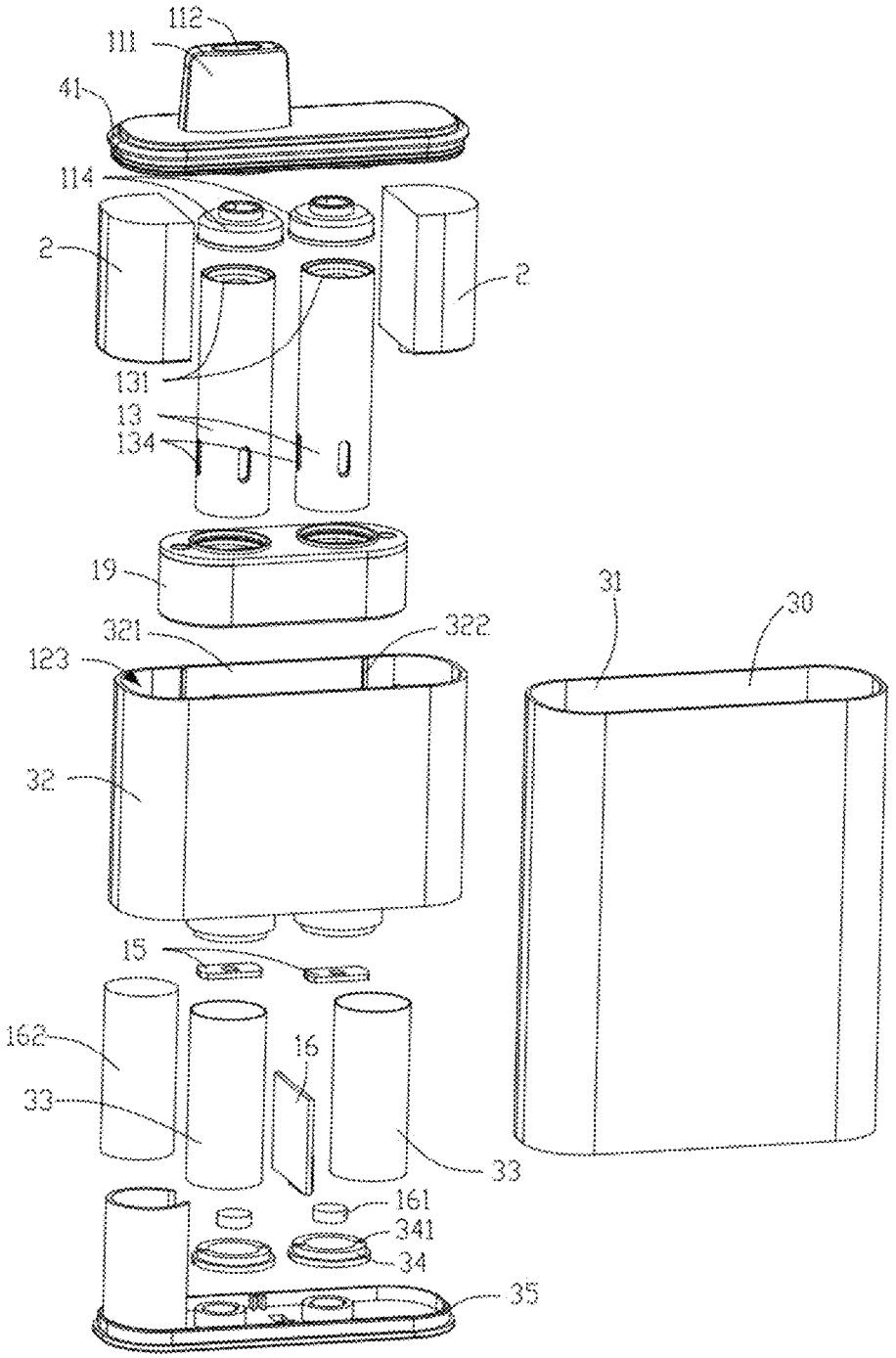
FIG. 9 is an exploded view of another embodiment according to the present invention.
Figure 10:
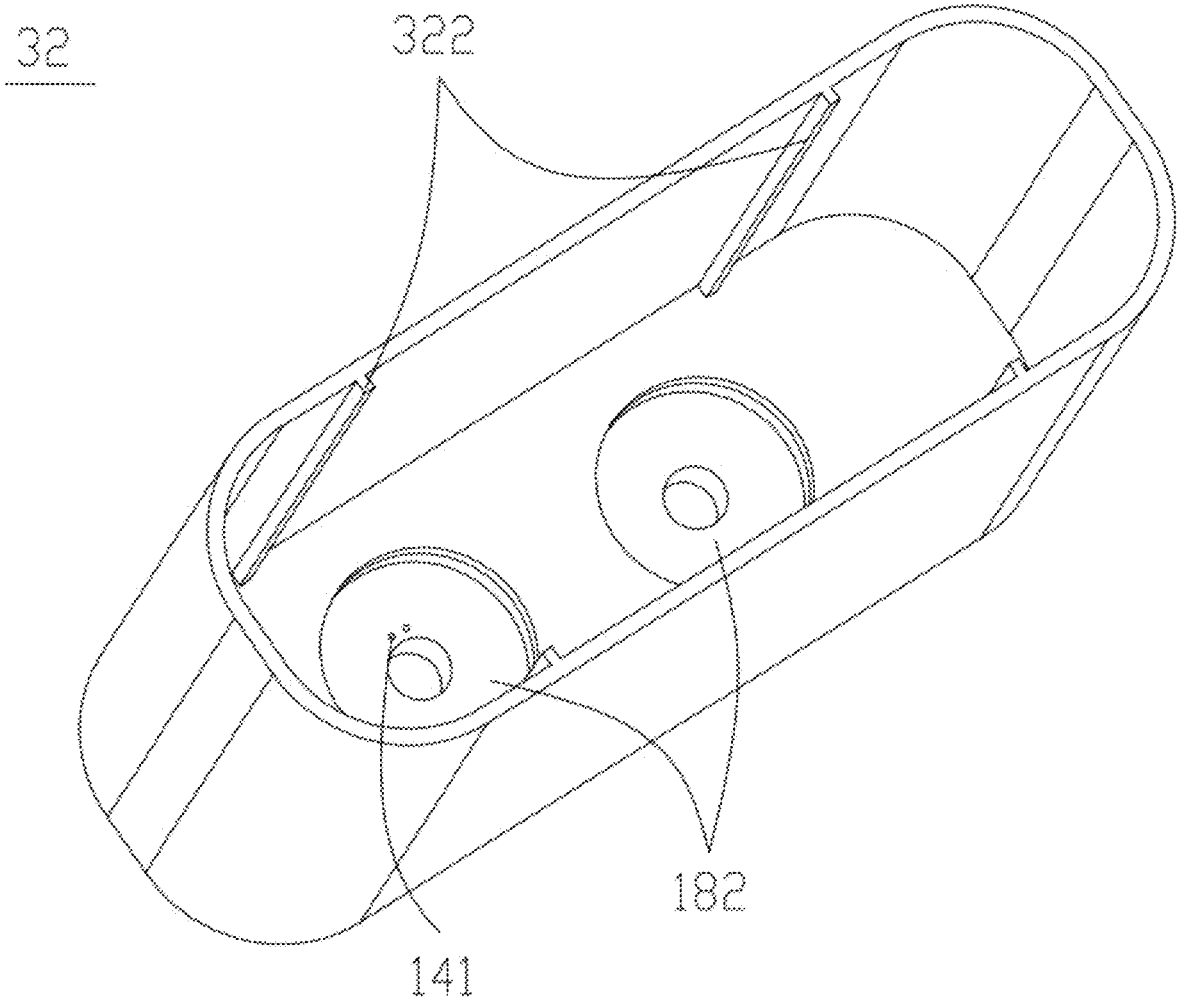
FIG. 10 is a structural diagram of an inner housing body in another embodiment according to the present invention.
Figure 11:
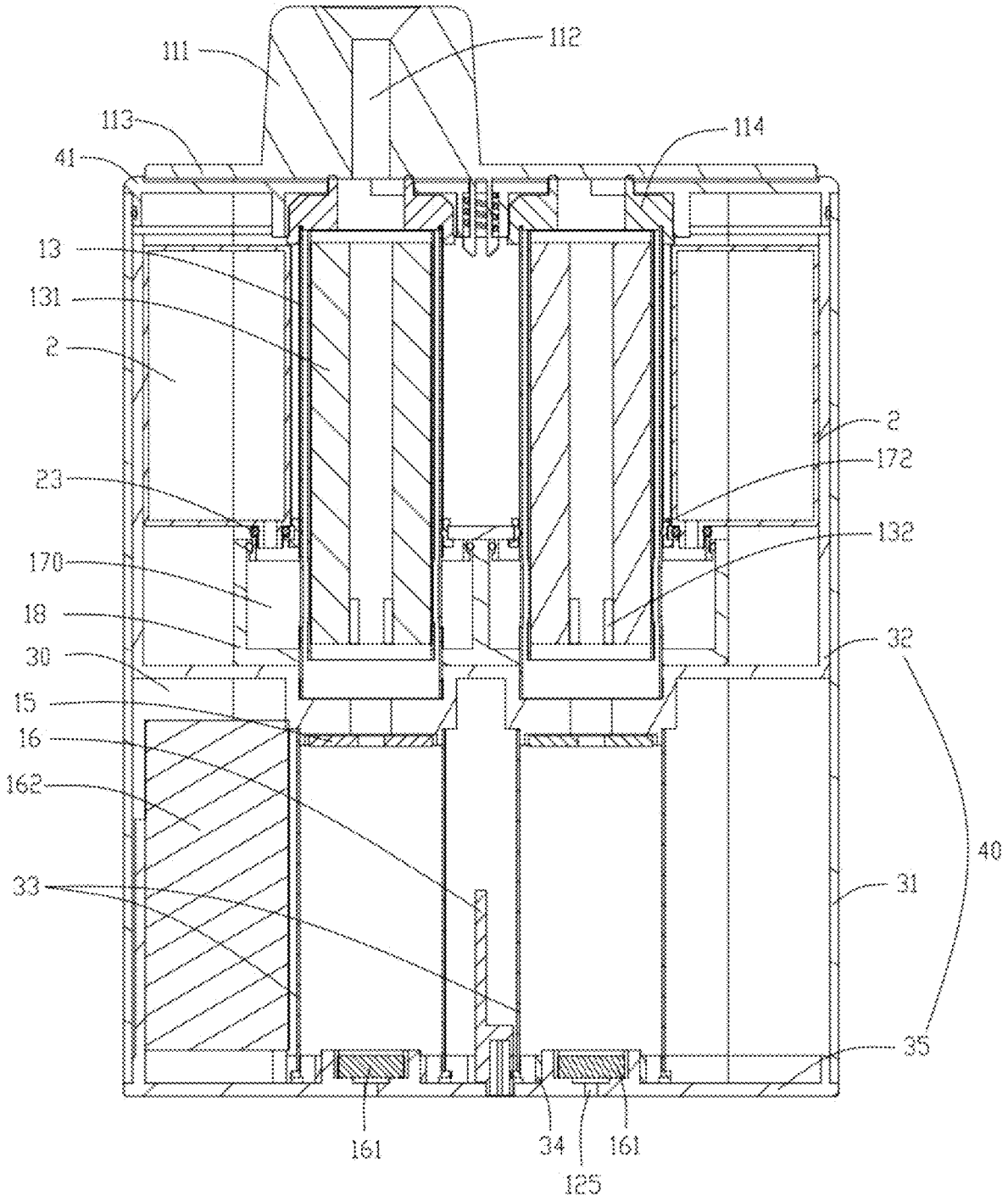
FIG. 11 is a sectional view along a center line of an aerosol outlet hole in another embodiment according to the present invention.
Figure 12:
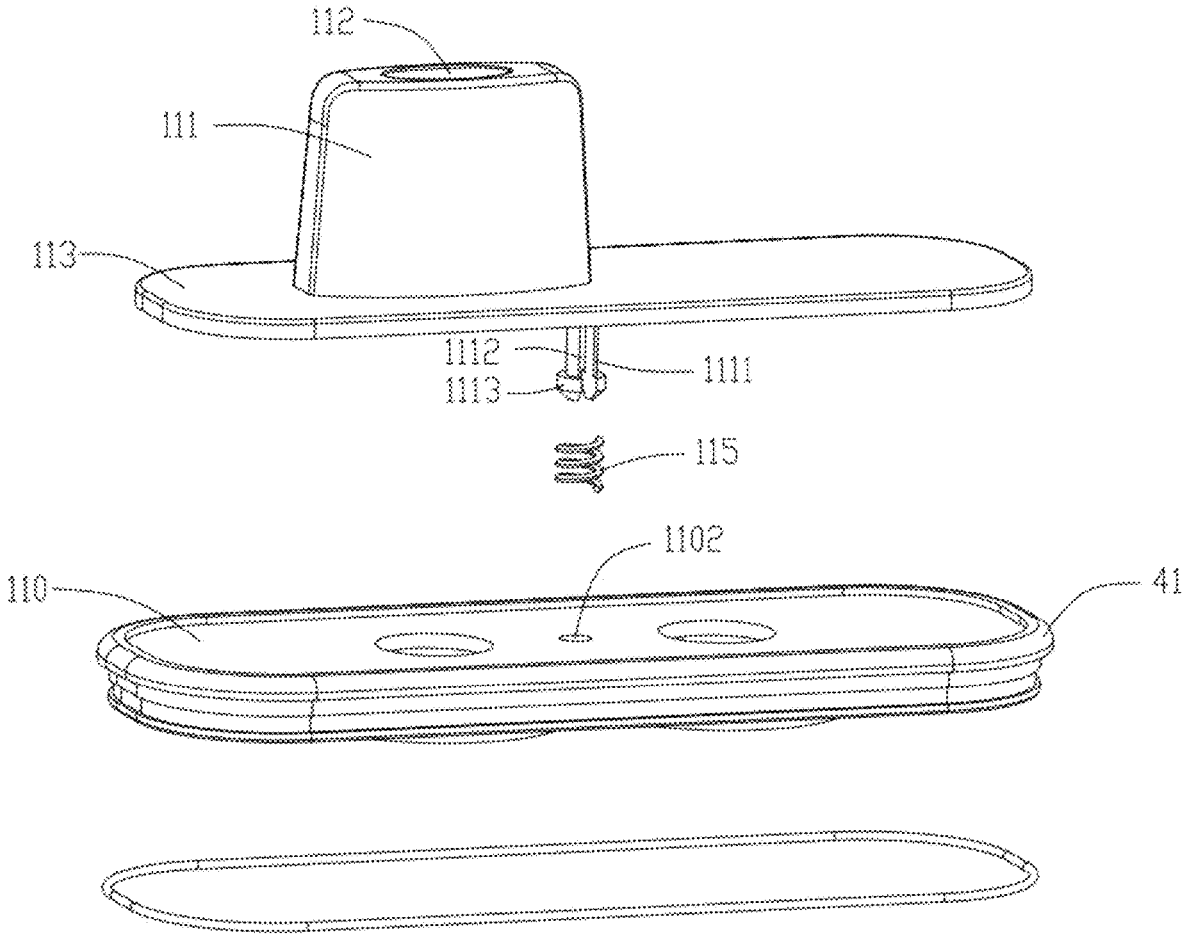
FIG. 12 is a partial exploded view of another embodiment according to the present invention.
Figure 13:
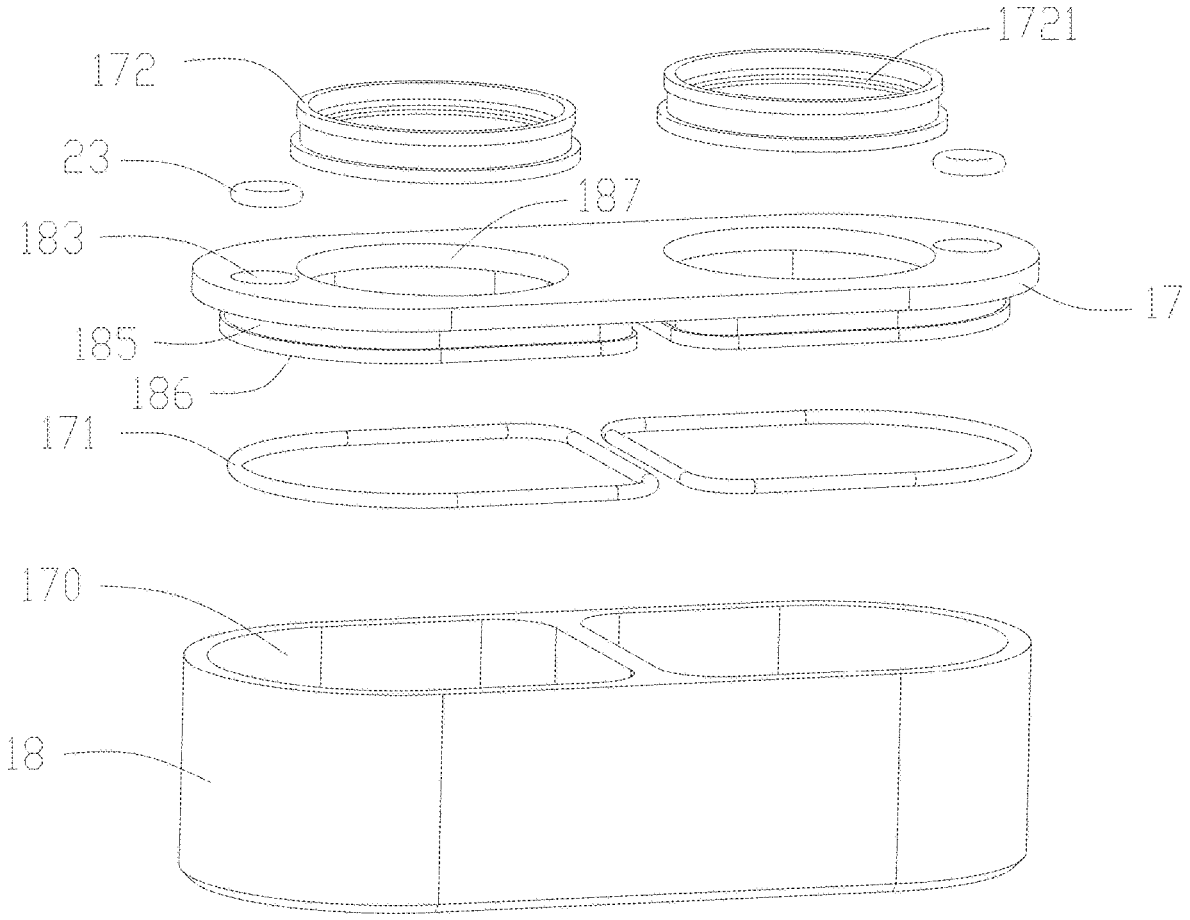
FIG. 13 is an exploded view of a liquid passing chamber in another embodiment according to the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

FIGS. 1-14 show an electronic cigarette according to embodiments of the present invention.

The electronic cigarette includes a main body of electronic cigarette 1, and liquid storage chambers 2 for storing tobacco liquid. The main body of electronic cigarette 1 is provided with installation cavities 123, and the liquid storage chambers 2 are at least partially placed inside the installation cavities 123. The liquid storage chambers 2 are provided with a liquid outlet hole 22 for discharging tobacco liquid. The main body of electronic cigarette 1 is equipped with a liquid passing chamber 19 and at least one atomizing core 130. A liquid passing cavity 170 is arranged inside the liquid passing chamber 19, and the liquid passing cavity 170 is in communication with an interior of the atomizing core 130. The liquid passing cavity 170 is positioned on an outer side of the atomizing core 130. After the liquid storage chambers 2 are assembled to the installation cavities 123, the liquid outlet hole 22 is in communication with the liquid passing cavity 170.

In this embodiment, by arranging the installation cavities 123 on the main body of electronic cigarette 1 to facilitate the installation of the liquid storage chambers 2, a capacity of tobacco liquid of the electronic cigarette is increased, a total number of puffs for users is increased, and a service life of the electronic cigarette is improved. Moreover, by configuring the liquid passing cavity 170 between the liquid storage chambers 2 and the atomizing core 130, the tobacco liquid flowing out of the liquid outlet hole 22 from the liquid storage chambers 2 is added to the atomizing core 130 through the liquid passing cavity 170, thereby solving the problem that a liquid tank of the electrical cigarette in the prior art is difficult to configure due to a small volume of the atomizing core 130, and facilitating the production of the electronic cigarette.

In one embodiment, the liquid storage chambers 2 can be inserted upside down into the installation cavities 123 from top to bottom. That is, when the users puff, the tobacco liquid in the liquid storage chambers 2 will flow downwards from the liquid outlet hole 22 and then automatically enter the atomizing core 130 for use by the atomizing core 130. In other embodiments, the liquid storage chambers 2 can also be inserted into the installation cavities 123 from below the main body of electronic cigarette 1 from bottom to top to achieve installation. That is, to allow the tobacco liquid inside the liquid storage chambers 2 to enter the atomizing core 130, the electronic cigarette needs to be inverted. Of course, in other embodiments, the liquid storage chambers 2 can also be positioned on a left side, a right side, a front end, a rear end of the atomizing core 130, or can be slantways inserted into the installation cavities 123, etc. That is, the installation cavities 123 can be positioned next to or below the atomizing core 130, etc. Here, a method of installing the liquid storage chambers 2 into the installation cavities 123 is not limited, and a positional relationship between the installation cavities 123 and the atomizing core 130 is not limited.

In one embodiment, at the time of leaving the factory, the liquid outlet hole 22 can be sealed with a cover or a layer of film to prevent the leakage of tobacco liquid.

In one embodiment, a joint structure is provided between the liquid passing chamber 19 and the liquid storage chambers 2. The joint structure includes a first insertion hole 183 and an insertion end 21 adapted for use with the first insertion hole 183. The insertion end 21 is provided with a first channel, and the first channel runs through the insertion end 21. After the liquid storage chambers 2 are assembled into the installation cavities 123, the insertion end 21 is at least partially placed inside the first insertion hole 183. Two ends of the first channel are respectively in communication with the liquid outlet hole 22 and the liquid passing cavity 170. By inserting the insertion end 21 into the first insertion hole 183, the tobacco liquid from the liquid storage chambers 2 can easily flow into the liquid passing cavity 170.

In one embodiment, the insertion end 21 is arranged on the liquid storage chambers 2, that is, the liquid outlet hole 22 is the first channel. The first insertion hole 183 is defined in the liquid passing chamber 19, and first sealing rings 23 are arranged between the insertion end 21 and the liquid passing chamber 19. By using the first sealing rings 23, liquid leakage can be prevented. In other embodiments, the insertion end 21 can also be provided on the liquid passing chamber 19, and the first insertion hole 183 can also be provided on the liquid storage chambers 2.

In one embodiment, a side projection of the first sealing rings 23 is in a shape of "I" in upper case. When the insertion end 21 is placed inside the first insertion hole 183, the first sealing rings 23 can be prevented from falling off from the first insertion hole 183. An inner side wall of the first sealing rings 23 is equipped with a first sealing protrusion 231 for abutting against an outer side wall of the insertion end 21. By utilizing the first sealing protrusion 231, when the insertion end 21 is placed inside the first insertion hole 183, the first sealing protrusion 231 can abut against the outer side wall of the insertion end 21 to provide a sealing effect.

In one embodiment, the atomizing core 130 includes: an annular housing body 13, a middle housing 131*a* provided within the annular housing body 13, liquid absorbing cotton 131 provided within the middle housing 131*a*, and a heating wire 132 provided at a bottom of the liquid absorbing cotton 131. The annular housing body 13 and the middle housing 131*a* are provided with a liquid passing hole 134, and the liquid passing hole 134 is in communication with the liquid passing cavity 170. By using the liquid absorbing cotton 131 to adsorb the tobacco liquid, when the liquid storage chambers 2 are not installed, the tobacco liquid in the atomizing core 130 can be prevented from leaking out of the atomizing core 130. Moreover, under the tobacco liquid's own gravity, the tobacco liquid will converge towards the bottom of the liquid absorbing cotton 131, so that when the heating wire 132 heats up, the tobacco liquid can be atomized.

In one embodiment, the annular housing body 13 is at least partially placed inside the liquid passing cavity 170, and the liquid passing hole 134 is defined at a position corresponding to the liquid passing cavity 170. A second sealing ring 172 is arranged between the annular housing body 13 and the liquid passing chamber 19. In this way, a structure of the electronic cigarette in this embodiment can be compact, and a volume of the electronic cigarette can be effectively reduced.

In one embodiment, the liquid absorbing cotton 131 is in an annular shape, and the heating wire 132 is positioned on a central axis of the liquid absorbing cotton 131, so that when the electronic cigarette heats up, the heating wire 132 heats up and atomizes the tobacco liquid to form aerosol, and the aerosol can be discharged.

In actual use, a capacity of the liquid absorbing cotton 131 to absorb tobacco liquid and a capacity of the liquid storage chambers 2 to store tobacco liquid can be customized by the manufacturers. For example, when the electronic cigarette in this embodiment leaves the factory, the liquid absorbing cotton 131 can adsorb 2 ml of tobacco liquid, and each of the liquid storage chambers 2 can store 10 ml of tobacco liquid. Alternatively, in other embodiments, the liquid absorbing cotton 131 can adsorb 1.8 ml of tobacco liquid, and each of the liquid storage chambers 2 can store 15 ml of tobacco liquid, etc.

In one embodiment, the liquid passing chamber 19 includes a first top housing 17 and a first outer housing 18. The first outer housing 18 is connected to the first top housing 17 to form the liquid passing cavity 170. A third sealing ring 171 is provided between the first top housing 17 and the first outer housing 18. The second sealing ring 172 is provided between the annular housing body 13 and the first top housing 17 to form the sealed liquid passing cavity 170 to prevent liquid leakage.

In one embodiment, the first top housing 17 extends downwards to form a first enclosure wall 186. A first slot 185 is provided on the first enclosure wall 186. The second sealing ring 172 is at least partially placed in the first slot 185, and the first enclosure wall 186 is placed in the liquid passing cavity 170. By using the first slot 185 to limit a position of the second sealing ring 172, when the first top housing 17 is assembled on the first outer housing 18, the second sealing ring 172 can be prevented from falling off, so that the second sealing ring 172 is positioned between the first enclosure wall 186 and the first outer housing 18.

In one embodiment, a second insertion hole 187 is provided on the first top housing 17 to allow the annular housing body 13 to be inserted into the liquid passing cavity 170. A side projection of the second sealing ring 172 is in a shape of "I" in upper case, and the second sealing ring 172 is arranged around a side wall of the second insertion hole 187 to prevent the insertion of the annular housing body 13 from causing the second sealing ring 172 to fall off. An inner side wall of the second sealing ring 172 is provided with a second sealing protrusion 1721 for abutting against the annular housing body 13, so as to achieve sealing between the annular housing body 13 and the first top housing 17.

In one embodiment, a receiving slot 181 is provided at a bottom of the liquid passing cavity 170, and a bottom of the annular housing body 13 is placed inside the receiving slot 181 to limit a position of the annular housing body 13. A bottom of the receiving slot 181 is provided with a through hole 188, and the through hole 188 is in communication with the annular housing body 13. A fourth sealing ring 145 is arranged between the bottom of the annular housing body 13 and a bottom surface of the receiving slot 181 to achieve sealing between the annular housing body 13 and the bottom of the liquid passing cavity 170.

In the above embodiments, the main body of electronic cigarette 1 is further equipped with a circuit board 16, a battery 162, and a pneumatic switch 161. The battery 162, the heating wire 132, and the pneumatic switch 161 are all electrically connected to the circuit board 16. The main body of electronic cigarette 1 is provided with an air inlet hole 125 at a position corresponding to the pneumatic switch 161. A top of the main body of electronic cigarette 1 is equipped with a mouthpiece 111. The mouthpiece 111 is provided with an aerosol outlet hole 112, and the aerosol outlet hole 112 is in communication with an interior of the annular housing body 13. Fifth sealing rings 114 are arranged between the mouthpiece 111 and the annular housing body 13. When the users puff, air enters through the air inlet hole 125, and the pneumatic switch 161 detects a pressure difference and feeds back an electrical signal to the circuit board 16. The circuit board 16 drives the heating wire 132 to generate heat based on this electrical signal to atomize the tobacco liquid and achieve aerosol discharge from the mouthpiece 111.

In one embodiment, the main body of electronic cigarette 1 is further equipped with an adapter board 15, and the adapter board 15 is electrically connected to the circuit board 16. The through hole 188 further penetrates through the adapter board 15. The adapter board 15 is positioned below the receiving slot 181. A pin of the heating wire 132 is welded to the adapter board 15 to fix the heating wire 132, and the heating wire 132 is electrically connected to the circuit board 16 through the adapter board 15.

In one embodiment, a total number of the atomizing core 130 and a total number of the liquid passing chamber 19 can both be one. A total number of the liquid storage chambers 2 and a total number of the installation cavities 123 can both be two. Each of the installation cavities 123 is used for assembling one of the liquid storage chambers 2. The two installation cavities 123 are both positioned below the liquid passing chamber 19. The circuit board 16, the battery 162, the pneumatic switch 161, and the adapter board 15 are all positioned between the two installation cavities 123. The circuit board 16 is positioned next to the battery 162. The pneumatic switch 161 is positioned below the circuit board 16. The adapter board 15 is positioned above the circuit board 16 and is arranged at a bottom of the receiving slot 181. The air inlet hole 125 is positioned at a bottom of the main body of electronic cigarette 1. The receiving slot 181 is formed by a downward depression of the liquid passing cavity 170. The through hole 188 is positioned on the first outer housing 18. In this way, one atomizing core 130 can be used in conjunction with two liquid storage chambers 2. Of course, in other embodiments, one atomizing core 130 can also be configured with one liquid storage chamber 2 for use, or one atomizing core 130 can be configured with three or four liquid storage chambers 2 for use.

In the above embodiments, in order to make a structure of the electronic cigarette compact and facilitate the production and manufacturing of the electronic cigarette, the main body of electronic cigarette 1 includes a second top housing 11, a second outer housing 121, and a first bottom housing 122. An upper end and a lower end of the second outer housing 121 are respectively connected to the second top housing 11 and the first bottom housing 122. An outer side wall of the first outer housing 18 extends outward to form a connecting enclosure wall 184. The connecting enclosure wall 184 is connected to the second outer housing 121 to achieve fixation of the liquid passing chamber 19. The mouthpiece 111 is positioned on the second top housing 11. The installation cavities 123 are surrounded and formed by the second outer housing 121, the first bottom housing 122, and the first outer housing 18. The fourth sealing ring 145 extends downwards to form an installation seat 14. The installation seat 14 passes through the through hole 188 and then is placed at a bottom of the liquid passing cavity 170. A bottom of the installation seat 14 is equipped with an installation slot 143. The adapter board 15 is arranged inside the installation slot 143. The installation slot 143 is provided with an avoidance hole 141 for avoiding a pin of the heating wire 132. Moreover, the installation seat 14 is in an annular shape, cooperating with the air inlet hole 125, the through hole 188, the atomizing core 130, and the aerosol outlet hole 112 to form an airflow channel, so as to exhaust the aerosol formed by the heating of the heating wire 132 during user's use.

In one embodiment, referring to FIGS. 8-13, there can be two atomizing cores 130, two liquid passing cavities 170, two receiving slots 181, two air inlet holes 125, two adapter boards 15, and two pneumatic switches 161. A total number of the liquid storage chambers 2 and a total number of the installation cavities 123 can both be two. Each of the installation cavities 123 is used for assembling one of the liquid storage chambers 2. The two liquid passing cavities 170 are horizontally arranged side by side. One end of each of the atomizing cores 130 passes through the liquid passing cavities 170 and then is placed in one of the receiving slots 181. The main body of electronic cigarette 1 is equipped with first tubes 33 at positions corresponding to the two atomizing cores 130, and each of the two pneumatic switches 161 is positioned in one of the first tubes 33. Each of the two air inlet holes 125 is arranged corresponding to one of the first tubes 33 and is in communication with an interior of the first tubes 33. Sixth sealing rings 34 are arranged between a bottom of the first tubes 33 and the main body of electronic cigarette 1, and first wiring holes 341 are defined on the sixth sealing rings 34. The circuit board 16 is positioned between the two first tubes 33, the battery 162 is positioned next to one of the first tubes 33, and each of the adapter boards 15 is arranged below one of the receiving slots 181. In this way, each of the two atomizing cores 130 can be used with one of the liquid storage chambers 2, and each of the atomizing cores 130 is equipped with one of the first tubes 33 for use, so that each of the atomizing cores 130 can be used separately. Moreover, different flavors of tobacco liquid are configured on the atomizing cores 130 to achieve different flavors and meet the needs of users with different tastes, thereby solving a problem of single flavors in an existing electronic cigarette.

In the above embodiments, a total number of the liquid passing chamber 19 is one, and the two liquid passing cavities 170 are formed by connecting the second top housing 11 to the second outer housing 121, thereby reducing the total number of the liquid passing chamber 19 and lowering costs. Of course, in other embodiments, the total number of the liquid passing chambers 19 can be two, and each of the liquid passing chambers 19 is equipped with one liquid passing cavity 170 for use.

In the above embodiments, the main body of electronic cigarette 1 includes a third top housing 41 and a third outer housing 40. The third outer housing 40 is connected to the third top housing 41 to form a first accommodating cavity 30. The third top housing 41 is detachably connected to the third outer housing 40. The atomizing cores 130, the installation cavities 123, the liquid passing chambers 19, the first tubes 33, the circuit board 16, the battery 162, and the adapter boards 15 are all positioned inside the first accommodating cavity 30. After the third top housing 41 is removed, it's convenient for the installation of the liquid storage chambers 2. Specifically, the third top housing 41 can be in interference fit with the third outer housing 40 through a rubber ring to achieve detachable connection, or the detachable connection between the third top housing 41 and the third outer housing 40 can also be achieved through a buckle.

A total number of the mouthpiece 111 is one, and a bottom of the mouthpiece 111 extends outward to form a front plate 113. The third top housing 41 is provided with a second slot 110, and the front plate 113 is placed inside the second slot 110. The front plate 113 is rotatably arranged on the third top housing 41. The aerosol outlet hole 112 is in communication with another atomizing core 130 when the front plate 113 rotates at a preset angle relative to the third top housing 41. In this way, when users need to use another atomizing core 130, the front plate 113 can be rotated to switch the atomizing core 130 for use, making it convenient for the users to use and preventing the large number and close distance of the mouthpiece 111 from affecting the users' use.

Specifically, the front plate 113 extends downwards to form a position limiting column 1111, and a bottom of the position limiting column 1111 extends outward to form a position limiting block 1113. The position limiting column 1111 is provided with a gap 1112, and the gap 1112 runs through the position limiting column 1111. The third top housing 41 is provided with a third insertion hole 1102 at a middle position between the two atomizing cores 130. The position limiting column 1111 is placed inside the third insertion hole 1102. An elastic member 115 is arranged between the position limiting block 1113 and the third top housing 41. By using the gap 1112, the position limiting column 1111 is divided into two parts, and the position limiting block 1113 can pass through the third insertion hole 1102. Moreover, by using the position limiting block 1113 to cooperate with the elastic member 115, the front plate 113 can abut against a surface of the third top housing 41. After the front plate 113 is pulled upwards, the elastic member 115 is compressed, thereby achieving a rotational connection between the front plate 113 and the third top housing 41. Specifically, the elastic member 115 is preferably a spring, and the spring is sleeved on the position limiting column 1111. Of course, in other embodiments, the elastic member 115 can also be an elastic sheet.

For the convenience of manufacturing the third outer housing 40, the third outer housing 40 includes a middle housing body 31, an inner housing body 32, and a second bottom housing 35. The middle housing body 31 is sleeved on an outer side of the inner housing body 32. The third top housing 41 and the second bottom housing 35 are respectively connected to an upper end and a lower end of the middle housing body 31. An opening 321 is defined on a top of the middle housing body 31. The receiving slots 181 are positioned on the inner housing body 32. The adapter boards 15 are arranged at a bottom of the inner housing body 32. An interior of the middle housing body 31 is equipped with convex columns 322 for limiting positions of the liquid storage chambers 2. The liquid passing chamber 19 is positioned inside the middle housing body 31, and the first tubes 33 are positioned below the middle housing body 31.

Of course, in other embodiments, a total number of the atomizing cores 130 is multiple, and a total number of the liquid storage chambers 2 is multiple. Each of the atomizing cores 130 can be used in conjunction with a plurality of liquid storage chambers 2. In practical application, the total number of the atomizing cores 130 can also be three, four, etc., and each of the atomizing cores 130 can be used with at least one of the liquid storage chambers 2.

Figure 14:
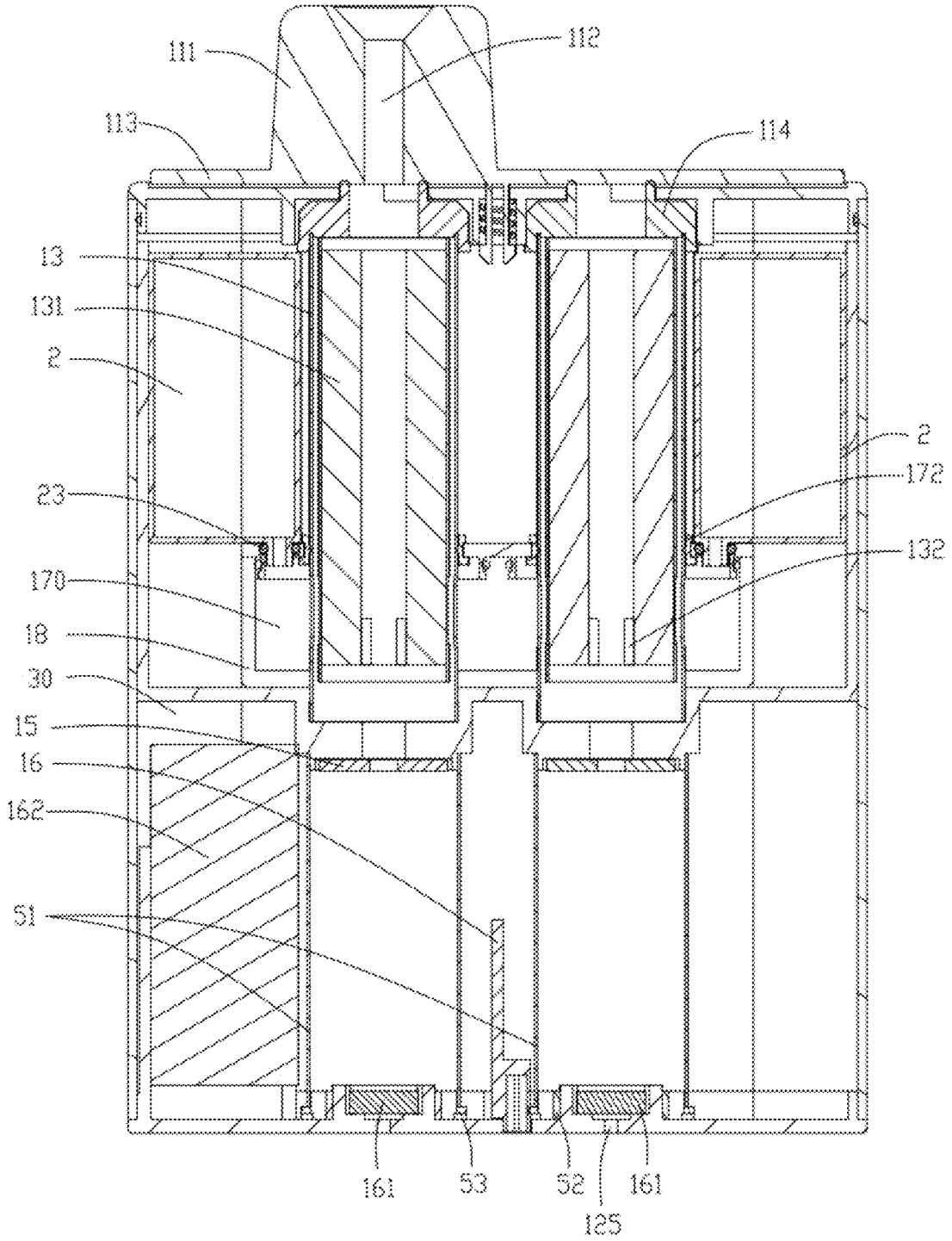
FIG. 14 is a sectional view along a center line of an aerosol outlet hole in another embodiment according to the present invention.

In one embodiment, referring to FIG. 14, there are two atomizing cores 130, two receiving slots 181, two air inlet holes 125, two adapter boards 15, two pneumatic switches 161, two liquid storage chambers 2, and two installation cavities 123. A total number of the liquid passing cavity 170 is one. Each of the installation cavities 123 is used for assembling one of the liquid storage chambers 2. The two atomizing cores 130 are arranged horizontally side by side. One end of each of the atomizing cores 130 passes through the liquid passing cavity 170 and then is placed in one of the receiving slots 181. The main body of electronic cigarette 1 is equipped with second tubes 51 at positions corresponding to the two atomizing cores 130. Each of the two pneumatic switches 161 is positioned in one of the second tubes 51. Each of the two air inlet holes 125 is arranged corresponding to one of the second tubes 51 and is in communication with an interior of the second tubes 51. A seventh sealing ring 52 is provided between a bottom of the second tubes 51 and the main body of electronic cigarette 1. A second wiring hole 53 is defined on the seventh sealing ring 52. The circuit board 16 is positioned between the two second tubes 51. The battery 162 is positioned next to one of the second tubes 51. Each of the adapter boards 15 is arranged below one of the receiving slots 181. In this way, it can be achieved that two atomizing cores 130 share one liquid passing cavity 170, and the two atomizing cores 130 can be used independently. By cooperating with the rotatable front plate 113 in the above embodiments, the mouthpiece 111 can be used by switching the atomizing cores 130, thereby facilitating the users' use.

Of course, in other embodiments, three or four atomizing cores 130 can also share one liquid passing cavity 170, etc.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. An electronic cigarette, comprising a main body of electronic cigarette, and liquid storage chambers for storing tobacco liquid;

wherein the main body of electronic cigarette is provided with installation cavities, the liquid storage chambers are at least partially placed inside the installation cavities, and the liquid storage chambers are provided with a liquid outlet hole for discharging tobacco liquid;

the main body of electronic cigarette is equipped with a liquid passing chamber and at least one atomizing core, a liquid passing cavity is arranged inside the liquid passing chamber, the liquid passing cavity is in communication with an interior of the atomizing core, and the liquid passing cavity is positioned on an outer side of the atomizing core;

after the liquid storage chambers are assembled to the installation cavities, the liquid outlet hole is in communication with the liquid passing cavity, and wherein a joint structure is provided between the liquid passing chamber and the liquid storage chambers;

the joint structure comprises a first insertion hole and an insertion end adapted for use with the first insertion hole, the insertion end is provided with a first channel, and the first channel runs through the insertion end; after the liquid storage chambers are assembled into the installation cavities, the insertion end is at least partially placed inside the first insertion hole, and two ends of the first channel are respectively in communication with the liquid outlet hole and the liquid passing cavity.

2. The electronic cigarette of claim 1, wherein the insertion end is arranged on the liquid storage chambers, the first insertion hole is defined in the liquid passing chamber, and first sealing rings are arranged between the insertion end and the liquid passing chamber.

3. The electronic cigarette of claim 2, wherein a side projection of the first sealing rings is in a shape of "I" in upper case, and an inner side wall of the first sealing rings is equipped with a first sealing protrusion for abutting against an outer side wall of the insertion end.

4. The electronic cigarette of claim 3, wherein the atomizing core comprises: an annular housing body, liquid absorbing cotton provided within the annular housing body, and a heating wire provided at a bottom of the liquid absorbing cotton; the annular housing body is provided with a liquid passing hole, and the liquid passing hole is in communication with the liquid passing cavity.

5. The electronic cigarette of claim 4, wherein the annular housing body is at least partially placed inside the liquid passing cavity, the liquid passing hole is defined at a position corresponding to the liquid passing cavity, and a second sealing ring is arranged between the annular housing body and the liquid passing chamber.

6. The electronic cigarette of claim 5, wherein the liquid absorbing cotton is in an annular shape, and the heating wire is positioned on a central axis of the liquid absorbing cotton.

7. The electronic cigarette of claim 5, wherein the liquid passing chamber comprises a first top housing and a first outer housing, the first outer housing is connected to the first top housing to form the liquid passing cavity, a third sealing ring is provided between the first top housing and the first outer housing, and the second sealing ring is provided between the annular housing body and the first top housing.

8. The electronic cigarette of claim 7, wherein the first top housing extends downwards to form a first enclosure wall, a first slot is provided on the first enclosure wall, the second sealing ring is at least partially placed in the first slot, and the first enclosure wall is placed in the liquid passing cavity.

9. The electronic cigarette of claim 8, wherein a second insertion hole is provided on the first top housing; a side projection of the second sealing ring is in a shape of "I" in upper case, and the second sealing ring is arranged around a side wall of the second insertion hole; an inner side wall of the second sealing ring is provided with a second sealing protrusion for abutting against the annular housing body.

10. The electronic cigarette of claim 9, wherein a receiving slot is provided at a bottom of the liquid passing cavity, and a bottom of the annular housing body is placed inside the receiving slot; a bottom of the receiving slot is provided with a through hole, and the through hole is in communication with the annular housing body; a fourth sealing ring is arranged between the bottom of the annular housing body and a bottom surface of the receiving slot.

11. The electronic cigarette of claim 10, wherein the main body of electronic cigarette is further equipped with a circuit board, a battery, and a pneumatic switch; the battery, the heating wire, and the pneumatic switch are all electrically connected to the circuit board, and the main body of electronic cigarette is provided with an air inlet hole at a position corresponding to the pneumatic switch;

a top of the main body of electronic cigarette is equipped with a mouthpiece, the mouthpiece is provided with an aerosol outlet hole, the aerosol outlet hole is in communication with an interior of the annular housing body, and fifth sealing rings are arranged between the mouthpiece and the annular housing body.

12. The electronic cigarette of claim 11, wherein the main body of electronic cigarette is further equipped with an adapter board, and the adapter board is electrically connected to the circuit board; the through hole further penetrates through the adapter board, the adapter board is positioned below the receiving slot, and a pin of the heating wire is welded to the adapter board.

13. The electronic cigarette of claim 12, wherein a total number of the atomizing core and a total number of the liquid passing chamber are both one, and a total number of the liquid storage chambers and a total number of the installation cavities are both two;

each of the installation cavities is used for assembling one of the liquid storage chambers, and the two installation cavities are both positioned below the liquid passing chamber; the circuit board, the battery, the pneumatic switch, and the adapter board are all positioned between the two installation cavities; the circuit board is positioned next to the battery, the pneumatic switch is positioned below the circuit board, the adapter board is positioned above the circuit board and is arranged at a bottom of the receiving slot, and the air inlet hole is positioned at a bottom of the main body of electronic cigarette;

the receiving slot is formed by a downward depression of the liquid passing cavity, and the through hole is positioned on the first outer housing.

14. The electronic cigarette of claim 13, wherein the main body of electronic cigarette comprises a second top housing, a second outer housing, and a first bottom housing; an upper end and a lower end of the second outer housing are respectively connected to the second top housing and the first bottom housing;

an outer side wall of the first outer housing extends outward to form a connecting enclosure wall, the connecting enclosure wall is connected to the second outer housing, and the mouthpiece is positioned on the second top housing; the installation cavities are surrounded and formed by the second outer housing, the first bottom housing, and the first outer housing;

the fourth sealing ring extends downwards to form an installation seat, the installation seat passes through the through hole and then is placed at a bottom of the liquid passing cavity, a bottom of the installation seat is equipped with an installation slot, the adapter board is arranged inside the installation slot, and the installation slot is provided with an avoidance hole for avoiding a pin of the heating wire.

15. The electronic cigarette of claim 12, wherein there are two atomizing cores, two liquid passing cavities, two receiving slots, two air inlet holes, two adapter boards, and two pneumatic switches; a total number of the liquid storage chambers and a total number of the installation cavities are both two, each of the installation cavities is used for assembling one of the liquid storage chambers, the two liquid passing cavities are horizontally arranged side by side, and one end of each of the atomizing cores passes through the liquid passing cavities and then is placed in one of the receiving slots;

the main body of electronic cigarette is equipped with first tubes at positions corresponding to the two atomizing cores, each of the two pneumatic switches is positioned in one of the first tubes, and each of the two air inlet holes is arranged corresponding to one of the first tubes and is in communication with an interior of the first tubes; sixth sealing rings are arranged between a bottom of the first tubes and the main body of electronic cigarette, and first wiring holes are defined on the sixth sealing rings;

the circuit board is positioned between the two first tubes, the battery is positioned next to one of the first tubes, and each of the adapter boards is arranged below one of the receiving slots.

16. The electronic cigarette of claim 15, wherein a total number of the liquid passing chamber is one, and the two liquid passing cavities are formed by connecting the second top housing to the second outer housing.

17. The electronic cigarette of claim 15, wherein the main body of electronic cigarette comprises a third top housing and a third outer housing, the third outer housing is connected to the third top housing to form a first accommodating cavity, and the third top housing is detachably connected to the third outer housing; the atomizing cores, the installation cavities, the liquid passing chambers, the first tubes, the circuit board, the battery, and the adapter boards are all positioned inside the first accommodating cavity;

a total number of the mouthpiece is one, and a bottom of the mouthpiece extends outward to form a front plate, the third top housing is provided with a second slot, and the front plate is placed inside the second slot; the front plate is rotatably arranged on the third top housing; the aerosol outlet hole is in communication with another atomizing core when the front plate rotates at a preset angle relative to the third top housing.

18. The electronic cigarette of claim 17, wherein the third outer housing comprises a middle housing body, an inner housing body, and a second bottom housing; the middle housing body is sleeved on an outer side of the inner housing body, the third top housing and the second bottom housing are respectively connected to an upper end and a lower end of the middle housing body, an opening is defined on a top of the middle housing body, the receiving slots are positioned on the inner housing body, and the adapter boards are arranged at a bottom of the inner housing body; an interior of the middle housing body is equipped with convex columns for limiting positions of the liquid storage chambers, the liquid passing chamber is positioned inside the middle housing body, and the first tubes are positioned below the middle housing body.

19. The electronic cigarette of claim 12, wherein there are two atomizing cores, two receiving slots, two air inlet holes, two adapter boards, two pneumatic switches, two liquid storage chambers, and two installation cavities; a total number of the liquid passing cavity is one;

each of the installation cavities is used for assembling one of the liquid storage chambers, the two atomizing cores are arranged horizontally side by side, one end of each of the atomizing cores passes through the liquid passing cavity and then is placed in one of the receiving slots;

the main body of electronic cigarette is equipped with second tubes at positions corresponding to the two atomizing cores, each of the two pneumatic switches is positioned in one of the second tubes, each of the two air inlet holes is arranged corresponding to one of the second tubes and is in communication with an interior of the second tubes, a seventh sealing ring is provided between a bottom of the second tubes and the main body of electronic cigarette, and a second wiring hole is defined on the seventh sealing ring;

the circuit board is positioned between the two second tubes, the battery is positioned next to one of the second tubes, and each of the adapter boards is arranged below one of the receiving slots.

* * * * *